US011486159B2

(12) United States Patent
Shull

(10) Patent No.: US 11,486,159 B2
(45) Date of Patent: Nov. 1, 2022

(54) PORTABLE WIND SCREEN ASSEMBLY AND METHOD

(71) Applicant: Kazian Shull, Columbia, SC (US)

(72) Inventor: Kazian Shull, Columbia, SC (US)

( * ) Notice: Subject to any disclaimer, the term of this patent is extended or adjusted under 35 U.S.C. 154(b) by 7 days.

(21) Appl. No.: 17/301,008

(22) Filed: Mar. 22, 2021

(65) Prior Publication Data

US 2022/0298825 A1 Sep. 22, 2022

(51) Int. Cl.
*E04H 15/00* (2006.01)

(52) U.S. Cl.
CPC ..... *E04H 15/005* (2013.01)

(58) Field of Classification Search
CPC ..... E04H 15/005
USPC ..... 135/903
See application file for complete search history.

(56) References Cited

U.S. PATENT DOCUMENTS 376,436 A * 1/1888 Harrison ..... G03B 21/58 160/264
2,619,101 A 11/1952 McGerry et al.
2,771,088 A * 11/1956 Soldan ..... E04H 15/003 135/904
2,886,047 A * 5/1959 Healy ..... E04H 15/003 135/904
3,187,761 A * 6/1965 De Maio ..... E04H 15/003 135/904
4,576,364 A 3/1986 O'Fearna
4,595,155 A * 6/1986 Gough ..... A63B 61/02 242/395.1
4,685,484 A 8/1987 Moneta
4,981,152 A 1/1991 Laurent
5,379,786 A 1/1995 Lynam
5,437,298 A * 8/1995 Lin ..... E04H 15/58 160/46
6,050,280 A * 4/2000 Jeske ..... E04H 15/08 135/117
6,092,792 A 7/2000 Camara
D440,411 S 4/2001 Gomes, Jr.
6,575,435 B1 6/2003 Kotzen
(Continued)

FOREIGN PATENT DOCUMENTS

WO WO2007059603 A1 5/2007

*Primary Examiner* — David R Dunn
*Assistant Examiner* — Danielle Jackson
(74) *Attorney, Agent, or Firm* — Southeast IP Group; Thomas L. Moses

(57) ABSTRACT

A portable wind screen assembly includes a pair of hollow support tubes and a flexible wind barrier that is attached to both support tubes at either end thereof. The first support tube includes a spring-loaded retracting mechanism positioned therein, and the flexible wind barrier is attached to the retracting mechanism so that it may be wound around the retracting mechanism and stored within the first support tube when not in use. The second support tube may be insulated to serve as a drink cooler and/or storage space for canned or bottled drinks may be stacked vertically within the second tube, and includes an access door on a bottom portion thereof for extracting drinks therefrom. The portable wind screen assembly may also include pivoting supports for stability, a rechargeable battery for recharging mobile electronic devices, a wireless speaker, and means for attachment to a beach chair or other additional windscreen assemblies.

18 Claims, 10 Drawing Sheets

(56) References Cited

U.S. PATENT DOCUMENTS

| | | | | |
|---|---|---|---|---|
| 6,779,537 | B1 * | 8/2004 | Miller | E04H 15/001 135/117 |
| 9,107,387 | B1 * | 8/2015 | Pavlik | A01K 3/00 |
| 10,455,911 | B1 * | 10/2019 | Sendi | A45B 17/00 |
| 2005/0269046 | A1 | 12/2005 | Freeman | |
| 2007/0193705 | A1 * | 8/2007 | Hsu | E04H 12/2215 160/238 |
| 2007/0228349 | A1 | 10/2007 | Smith | |
| 2009/0294078 | A1 | 12/2009 | Feldpausch et al. | |
| 2010/0175731 | A1 | 7/2010 | Day | |
| 2015/0330087 | A1 * | 11/2015 | Taylor | E04F 10/0688 160/69 |
| 2017/0196216 | A1 * | 7/2017 | Pichik | A01M 31/00 |
| 2018/0016839 | A1 * | 1/2018 | Jeong | E06B 9/08 |
| 2018/0238110 | A1 | 8/2018 | Lesli | |
| 2020/0024862 | A1 * | 1/2020 | Bianchi | E01F 7/025 |

* cited by examiner

PORTABLE WIND SCREEN ASSEMBLY AND METHOD

FIELD OF THE INVENTION

The present invention relates to wind screen assemblies that are typically used at the beach or pool for blocking wind while sunbathing or participating in other outdoor activities. More specifically, the present invention is directed to a portable wind screen assembly that includes a pair of hollow vertical support columns, wherein one column includes a spring-loaded retraction mechanism for retracting the wind screen into the support column while the wind screen assembly is not in use.

BACKGROUND OF THE INVENTION

Throughout history, people have been drawn to beaches worldwide for rest, relaxation, and recreation. One favorite beach activity is sunbathing, where a person lies down on a towel, beach chair, lawn chair or the like, to relax and work on a suntan. One problem associated with this activity is that wind can create havoc during these activities by blowing sand on sunbathers, blowing pages of their books around, and pushing beach balls, toys and other accessories downwind. It would be desirable, therefore, to provide a portable, lightweight wind screen assembly to block the wind during these and other outdoor activities.

Heretofore, attempts have been made to develop and commercialize portable wind screens and similar devices. The following references disclose various windscreen type mechanisms, and these documents are hereby incorporated herein by reference, in their entireties:

U.S. Pat. No. 4,576,364 Portable Wind Screen

A portable screen of fabric is held upright by a plurality of hollow poles clamped to the fabric by C clamps, preferably one the length of the pole. A stake is telescoped within each hollow pole, and held in an extended position (to adjust the height of the screen) by the friction of a resilient sleeve near the top of the stake, and additionally by a C clamp around the stake adjusted up against the pole. Straps are provided to secure the screen in a rolled up condition, and to carry the rolled up screen.

U.S. Pat. No. 4,685,484 Wind Shelter

An improved wind shelter with an arm mechanism which urges arm segments interconnecting adjacent posts into a horizontal, aligned and opposing position when the wind shelter is in use and which urges such arm segments towards a position in which they are contiguous along their lengths when the wind shelter is collapsed for transportation, the fabric of the wind shelter having parallel pockets for receiving posts and an upper flap portion for removably attaching the fabric to the posts.

U.S. Pat. No. 4,969,500 Wind Screen Apparatus

A wind screen apparatus is set forth wherein a plural series of screen sections are provided with post members secured therebetween. The screen sections include cylindrical pockets orthogonally aligned relative to the longitudinal extent of each screen section for securely receiving an associated post therein. Each post includes a pointed lowermost end for securement each post into a soil or sand support. The screen organization further includes electrical line and illumination members mounted on each screen section for illumination of each screen section for visibility during periods of limited light condition, such as during the evening hours. Further, a support member with handles mounted on each end thereof is provided for transport of the apparatus when the apparatus is inter-rolled about itself.

U.S. Pat. No. 4,981,152 Portable Foldable Beach Screen

A portable, foldable beach screen provides privacy and protection from wind and blowing sand for a reclining individual. The screen is constructed from a single panel and is foldable into a compact and easily carried configuration. The screen may include a reflective material on one or both major surfaces and can carry advertising messages or other printing.

U.S. Pat. No. 5,379,786 Folding Windbreak and Shade Screen System

A folding windbreak and shade screen comprising a plurality of sections attached by means of hinges. The folding windbreak and shade screen is secured in place in the dam configuration by means of ground stakes slidably disposed within lower housings attached to the sections. The ground stakes may be locked into upper housings in order to stack one folding windbreak and shade screen in the dam configuration atop another folding windbreak and shade screen in the dam configuration. The folding windbreak and shade screen may be installed in an arch configuration by means of arch stakes slidably disposed within arch housings, and a variety of guy lines.

U.S. Pat. No. 6,092,792 Portable Environmental Barrier Apparatus

A portable barrier apparatus is disclosed in this specification defining a multi-sectioned barrier for protection against wind and sand in various outdoor environments. Additionally the barrier may assembled and used as a child or pet restraint enclosure, a privacy barrier, or a temporary personal effect storage site. The apparatus includes a connected plurality of flexible barrier panel members which may be supported in an upright manner with a plurality of pole members. The apparatus further includes a protective panel member which generally covers the barrier panel members in an undeployed configuration. The invention provides a compact transport-configured package for user carrying of the barrier.

U.S. Pat. No. 6,575,435 Retractable Barrier System

A retractable barrier system for preventing unsupervised access to dangerous areas by children. The retractable barrier system includes an housing with an elongate perimeter wall, a bottom wall and a top wall which define an interior space; a barrier assembly positionable within the housing and extending through a slot of the housing; a biasing assembly for selectively retracting the barrier assembly into the housing; a receiving housing for selectively coupling to the barrier assembly; and an alarm assembly positioned within the receiving housing to provide an aural warning when the barrier assembly is disconnected from the receiving housing.

U.S. Patent Application No. US20050269046

A portable wind screen is provided, including: a sheet of material having a sheet first end and sheet second end; a first pole coupled with the sheet of material adjacent to the sheet first end; a second pole coupled with the sheet of material adjacent to the sheet second end; a first handle connected to a connection portion of the wind screen; a second handle connected to a second connection portion of the wind screen, and an engagement means configured to selectively engage the first handle and the second handle with each other.

U.S. Patent Application No. US20060131551 Retractable Barrier

A retractable barrier (10) includes an elongate housing (12) having a first end (14), a second end (16), and a slotted opening (18) extending between the first end (14) and the second end (16). A substrate support (20) is rotatably mounted within the housing (12). A barrier substrate (22) is provided of a height substantially equal to a length of the slotted opening (18). The barrier substrate (22) has an attachment end (26) and a free end (24). The barrier substrate (22) is rolled onto the substrate support (20) with the attachment end (26) being attached to the substrate support (20) and the free end (24) extending through the slotted opening (18) of the housing (12) to permit a selected quantity of the barrier substrate (22) to be extended from the housing (12). The barrier substrate (22) is configurable into non-linear configurations by the selectively attaching poles (28) where a change of direction occurs. A crank (32) is provided for rotating the substrate support (20), thereby retracting the barrier substrate (22) back into the housing (12).

U.S. Patent Application No. US20070228349 Portable Privacy Fence Incorporating Ground Secured Posts, Each Including a Mesh Unwinding Section and a Succeeding Supporting Section An assembly for creating a portable enclosure includes a plurality of individual and elongated ground engaging units, each having an elongated body and an end extending ground engaging portion. A magazine fixedly secures in vertically extending fashion along each of the units, a screen adapted to being withdrawn from the magazine and including hooks defined along a forward withdrawable edge. A plurality of rings extend along a further vertically extending edge associated with each of the units, and which is adapted to receive the hooks associated with a screen withdrawn from a succeeding located unit, in order to construct a barrier between the units.

U.S. Patent Application No. US20090294078 Privacy Screen Assembly

A privacy screen assembly has a first elongated support, a second elongated support, and a privacy screen having a first end operably coupled with the first elongated support and a second end operably coupled to the second elongated support, wherein the first privacy screen is positionable between a retracted position and a deployed position. A support member vertically supports the privacy screen and is positionable between a retracted position, wherein the support member is stored within an interior of one of the first elongated support and the second elongated support in a substantially linear configuration, and a deployed position, wherein a substantial portion of the support member extends from the interior of the elongated support and wherein a substantial portion of the support member exits the interior of the elongated support such that less of the support member is present in the interior of the elongated support.

U.S. Patent Application No. US20100175731 Wind and Sand Barrier

A wind and sand barrier for shielding beach-goers and the like. The barrier comprises an elongated panel of flexible material that is supported a plurality of stakes extending through sleeves on the panel and then into the ground. Each stake is topped by an inverted dish-shaped handle to facilitate pushing the stakes into the ground with the user's hand. A plurality of slits are cut into the panel to define flaps for relieving wind pressure against the panel.

U.S. Patent Application No, US20180238110 Portable, Adjustable, Privacy, Wind and Shade Apparatus A portable apparatus that provides privacy, wind reduction, and shade to a desired location is disclosed. The apparatus comprises a shade fabric that fits over vertical posts, each post has a ground stake attached to the bottom end. The ground stakes allow for simple placement and securing the unit in desired locations. For additional stability, a horizontal pole fits to the top of a two vertical posts by using connectors that hold the vertical posts in place. The center connecter is adjustable so the apparatus can positioned at various angles. The apparatus can easily be repositioned or relocated throughout the day as the sun moves or the wind shifts. The unit is light weight and can easily be taken apart, the fabric rolled up, and all parts fit into a carry bag for convenient transportation and storing while not in use.

WO2007059603 Retractable Barrier

A retractable barrier (10) includes an elongated housing (12) having a first end (14), a second end (16), and a slotted opening (18) extending between the first end (14) and the second end (16). A substrate support (20) is mounted within the housing (12). Substrate support (20) also includes a slotted opening (18). A barrier substrate (22) is provided of a height substantially equal to a length of the slotted opening (18). The barrier substrate (22) is rolled onto a shaft (73) Shaft (73) is positioned inside substrate support (20). A free end (24) of the barrier substrate (22) extends through the slotted opening (18) of housing (12). An end cap (45) is fixed at the first end (14) of the barrier support (20). The end cap (45) has a plurality of receptacles (46) spaced about a 360 degree circumference. A crank handle (48) is provided on a crank mounted on a rotatable crank support (44). Shaft (73) is attached to crank handle (48) such that turning crank handle (48) rotates shaft (73). The crank handle (48) has an operative position and a locking position. In the locking position, a cam (50) carried by the crank handle (48) engages one of the receptacles (46) on the end cap (45) to non-rotatably fix the substrate support (20) to the housing (12).

BRIEF SUMMARY OF THE INVENTION

In accordance with one aspect of the invention, a first embodiment of a portable wind screen assembly includes a pair of hollow support tubes and a flexible wind barrier that is attached to both support tubes at either end thereof. The first support tube includes a spring-loaded retracting mechanism positioned therein, and the flexible wind barrier is attached to the retracting mechanism so that it may be wound around the retracting mechanism and stored within the first support tube when the portable wind screen assembly is not in use. The first tube includes a vertical slot in on side thereof, so that the flexible wind barrier may be extended from and retracted into the first support tube.

In some embodiments, the second support tube may serve as a drink cooler and/or storage space for various items. For example, a series of canned or bottled drinks may be stacked vertically within the second tube, which may also include a layer of insulation to keep the drinks cold. An access door may be hingedly attached near the bottom of the second support tube, so that a user may have access to the bottles or cans stacked therein while the wind screen assembly is set up in its expanded configuration.

Optionally, each support tube may also include pivoting supports to provide stability to the wind screen assembly in its expanded configuration during use. These pivoting supports are attached to the bottom portions of the support tubes, and may pivot between a vertical storage and transport position in parallel relation with the support tubes and a horizontal position at a generally right angle with respect to the support tubes while the wind screen assembly is in use in its expanded configuration.

Other optional features include a rechargeable battery with USB or other types of electrical outlets that may be used to charge various electronic devices, clips or other attachment means for connecting multiple wind screen assemblies into a variety of different configurations, clips or connectors for attaching the wind screen apparatus to a beach chair or the like, and a wireless Bluetooth speaker and/or AM/FM radio that is disposed on or within one of the support columns. Additional features may be included, and are discussed in more detail hereinbelow.

BRIEF DESCRIPTION OF THE DRAWINGS

These and other features, aspects, and advantages of the present invention will become better understood with regard to the following description, appended claims, and accompanying drawings where:

FIG. 15 is a perspective front view of one embodiment of a pair portable wind screens that are positioned in linear fashion next to one another, wherein the clip shown in FIG. 14 is used to temporarily attach a support tube from the first portable wind screen to an adjacent support tube from the second portable wind screen.

DETAILED DESCRIPTION OF THE INVENTION

The present invention includes, in a first embodiment, a portable wind screen assembly 10 includes a pair of hollow support tubes 12*a* and 12*b* and a flexible wind barrier 14 that is attached to both support tubes 12*a* and 12*b* at either end thereof, as shown in FIGS. 1-18. The first support tube 12*a* includes a spring-loaded retracting (winding) mechanism positioned therein, and the flexible wind barrier 14 is attached to the retracting mechanism so that it may be wound around the retracting mechanism and stored within the first support tube 12*a* when the portable wind screen assembly 10 is not in use. The winding mechanism operates similarly to many roller shade winding mechanisms that are widely known, used and commercially sold. A preferred winding mechanism includes a roller that rotates about an axis and is operationally connected to a tension spring which biases the rotation of the roller in one rotational direction. The winding mechanism preferably includes a stopping mechanism, so that the wind screen may be extended to a desired length and temporarily secured in place, but may be released when retraction is desired. Examples of suitable winding mechanisms are disclosed and described in U.S. Pat. Nos. 6,155,328; 6,467,714; 6,615,897; and 7,624,785, and each of these references are hereby incorporated by reference, herein. It should be understood that any suitable winding mechanism may be used and incorporated into the instant wind screen assembly, and such winding or retracting mechanisms are widely used components in a vast array of products, and are thus well-known.

Figure 11:
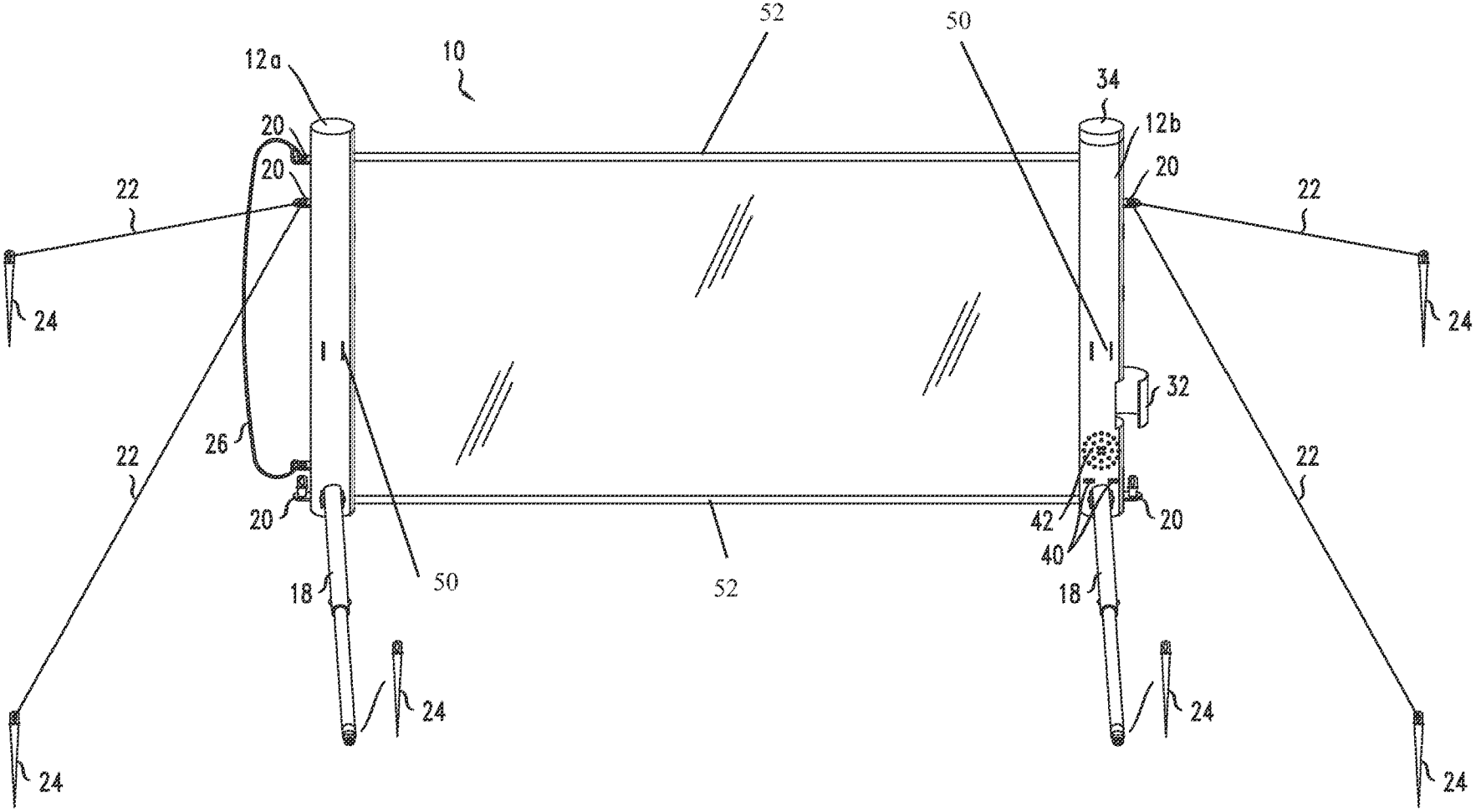
FIG. 11 is a perspective front view of one embodiment of the portable wind screen in its expanded configuration, wherein two support members are spread apart and a flexible wind screen barrier is stretched therebetween, the pivoting supports are folded down into a horizontal configuration at right angles with respect to the support tubes, and a series of lines and stakes attached to the support tubes for support in windy conditions, and further showing a wireless speaker disposed within one of the support members.

The flexible wind barrier 14 is preferably made of a flexible, durable material, such as a heavy-duty polymer material such as low density polyethylene (LDPE), plastic, polyurethane coated canvas, uncoated canvas, or any other suitable flexible material, and may be clear, translucent, or opaque, as desired. The first support tube 12*a* includes a vertical slot 16 in on side thereof, so that the flexible wind barrier 14 may be extended from and retracted into the first support tube 12*a*. Additionally, a strength member 52 may be integrated into the wind barrier 14 to provide resistance to bending during high winds, as shown in FIG. 11. The strength member 52 is preferably deployed along a top and/or bottom edge of the wind barrier 14, and may take the form of a small cable or strip of metal that is shaped and fashioned similarly to a retractable tape measure, for example. Any suitable strength member 52 may be used, so long as it is capable of being wound onto the winding mechanism along with the wind barrier 14.

Figure 5:
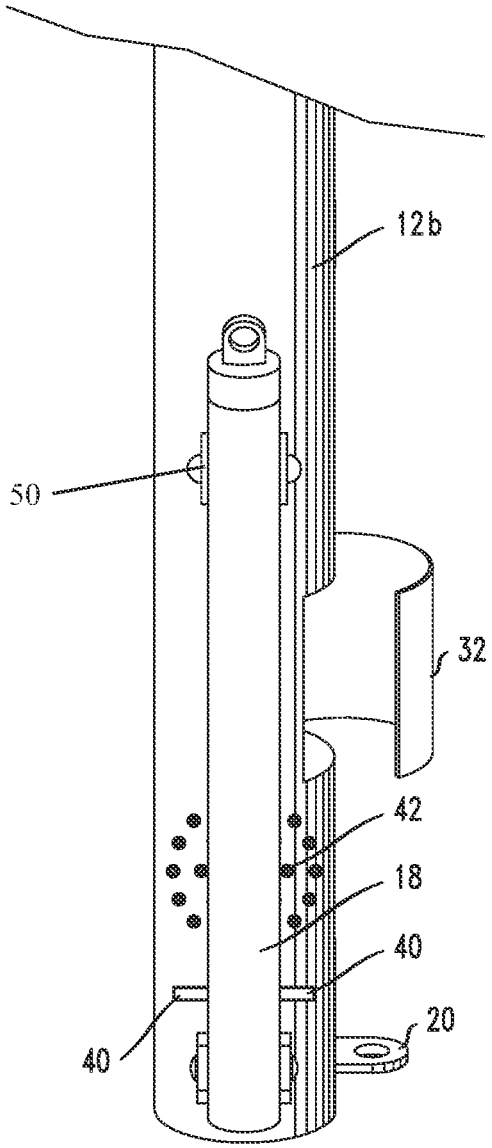
FIG. 5 is a perspective view of one embodiment of the lower portion of a hollow support tube, showing the proximal end of the pivoting support member attached to the lower portion of the hollow support tube via a hinge member, wherein the pivoting support member is disposed in a vertical position parallel with the support tube, an access door positioned on one side of the support tube, wherein the access door is in an open position, a wireless speaker disposed within the support tube, and an anchor point extending outwardly from the side of the support tube for attachment of a strap.
Figure 6:
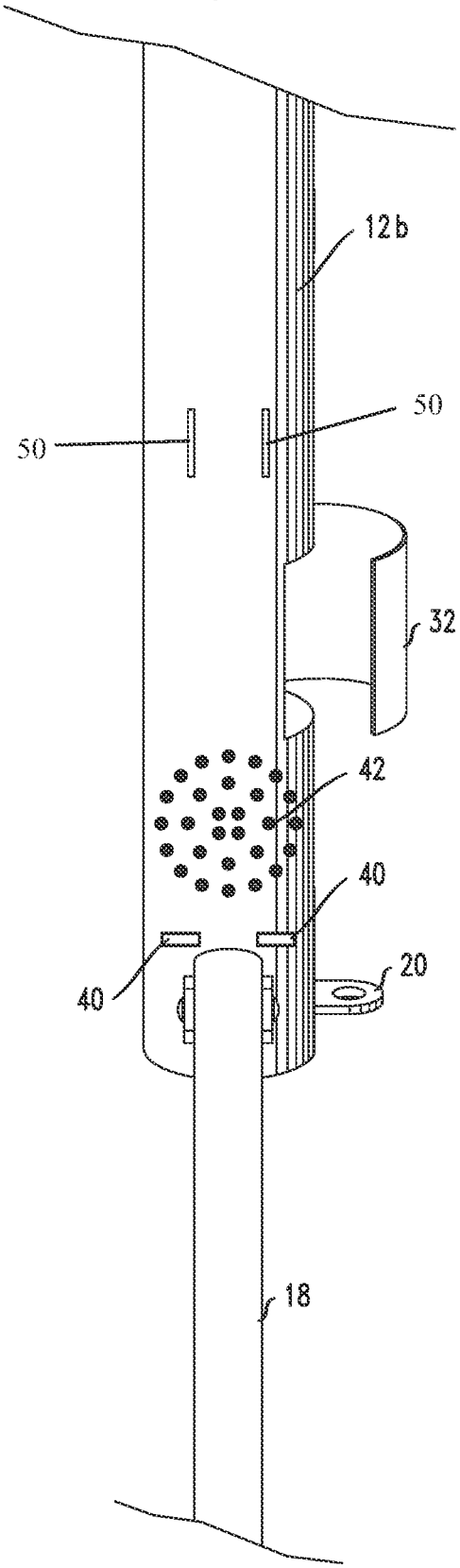
FIG. 6 is a perspective view of one embodiment of the lower portion of a hollow support tube as shown in FIG. 5, showing the proximal end of the pivoting support member attached to the lower portion of the hollow support tube via a hinge member, wherein the pivoting support member is disposed and temporarily secured in a horizontal position at a right angle with respect to the support tube, an access door positioned on one side of the support tube, wherein the access door is in an open position, a wireless speaker disposed within said support tube, and an anchor point extending outwardly from the side of the support tube for attachment of a strap.
Figure 7:
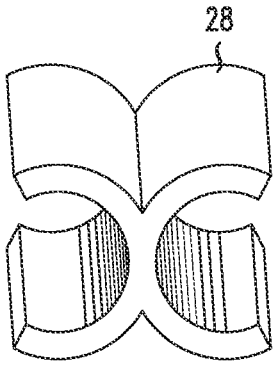
FIG. 7 is a perspective view of one embodiment of a clip, wherein the clip includes C-shaped sections on either end thereof, and wherein one C-shaped section is attachable to the frame of a chair, and the other C-shaped section is attachable to a pivoting support member.
Figure 8:
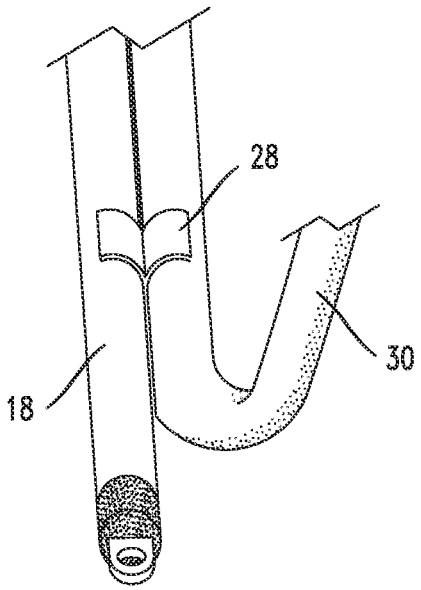
FIG. 8 is a perspective view of the clip shown in FIG. 7 in use connecting a pivoting support member to the frame of a chair.
Figure 9:
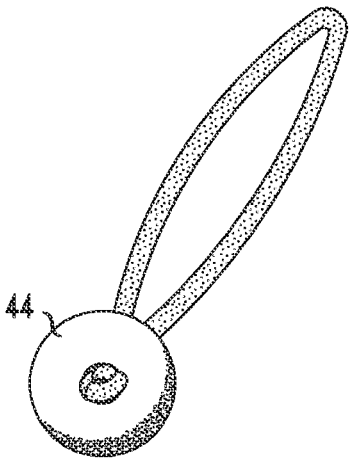
FIG. 9 is a perspective view of one embodiment of a stretchable ball and loop fastener that is attachable to an opposed pair of pivoting support members or an adjacent pair of support tubes.

Each tube preferably includes a pivoting support 18 that may pivot or rotate between a vertical position to a horizontal position, as shown in FIGS. 5 and 6, so that each pivoting support 18 rests on the ground or a flat surface to provide stability to the wind screen assembly 10 in its expanded configuration during use. These pivoting supports 18 are attached to the bottom portions of the support tubes 12*a* and 12*b*, and may pivot between a vertical storage and transport position in parallel relation with the support tubes (shown in FIG. 5) and a horizontal position at a generally right angle with respect to the support tubes 12*a* and 12*b* while the wind screen assembly 10 is in use in its expanded configuration (shown in FIG. 6). Preferably, the pivoting supports 18 include a temporary locking mechanism for securing them in either a vertical position (parallel to the support tubes) or a horizontal position (at a right angle with respect to the support tubes). Such locking mechanisms are well-known, and may include a pivoting lock, a spring loaded button that fits into multiple holes in different positions, a locking pin mechanism, a snap fit mechanism 50 (as shown in FIGS. 5, 6, and 11 for use in the vertical, parallel position) or the like.

Figure 1:
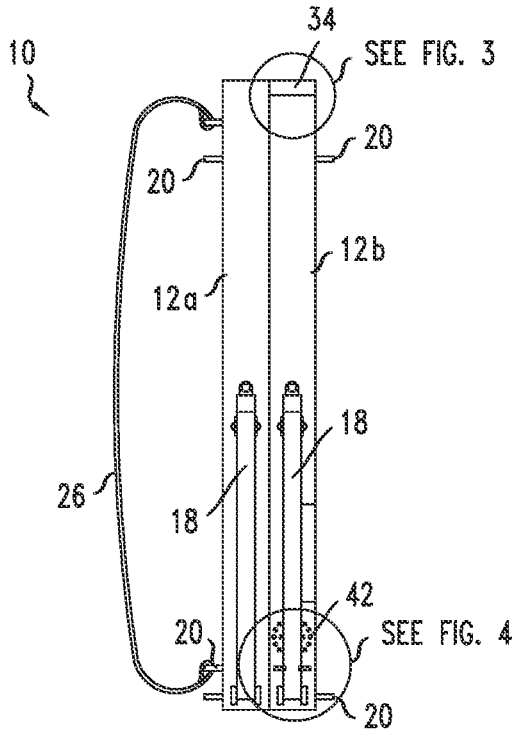
FIG. 1 is a front view of one embodiment of a portable wind screen assembly, including a pair of support tubes, a strap member attached to one of the support tubes, and including a pair of pivoting support members, each pivoting support member being pivotally attached to a bottom portion of a support tube, and wherein the portable wind screen assembly is in its retracted, compact state.
Figure 2:
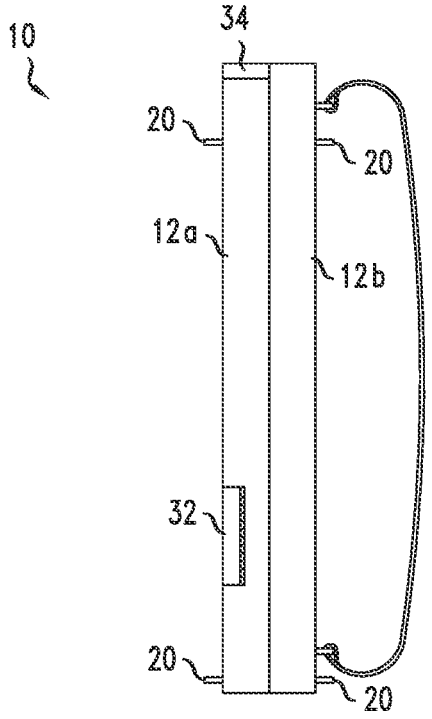
FIG. 2 is a rear view of one embodiment of a portable wind screen assembly, including a pair of support tubes, a strap member attached to one of the support tubes, and a hinged access door positioned on a bottom portion of the other support tube, wherein the portable wind screen assembly is in its retracted, compact state.

Each support tube 12*a* and 12*b* also may include anchor points 20 extending outwardly near the top portion thereof, so that cords 22 may be attached thereto at a first end, and may further be attached to stakes 24 that are placed into the ground at the second, distal end of the cords 22, as shown in FIGS. 11 and 15. Anchor points 20 may be disposed at the bottom of each support tube, as well, so that stakes 24 may either be placed directly through the anchor points 20 and into the ground, or short cords 22 may be attached to the anchor points 20 at one end, and attached to a stake 24 at the other end thereof. Additionally, a strap member 26 may be removably attached to either of the support tubes 12*a* or 12*b*, also via attachment points 20 in desired locations, as shown in FIGS. 1, 2 and 11. The strap member 26 is preferably adjustable in length, and may include clips on either end for attachment to the support tubes 12*a* and 12*b*.

Figure 13:
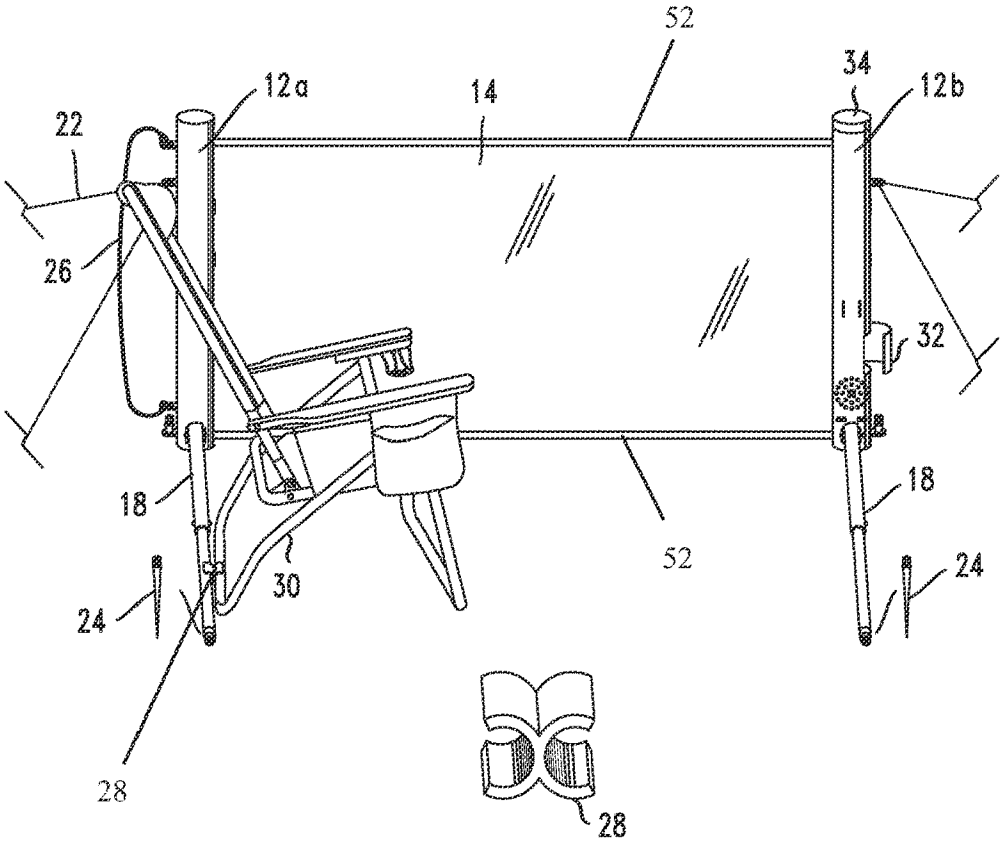
FIG. 13 is a front perspective view of a beach chair and one embodiment of the portable wind screen in its expanded configuration, wherein the chair frame is attached to a pivoting support via a clip as shown in FIG. 7.
Figure 12:
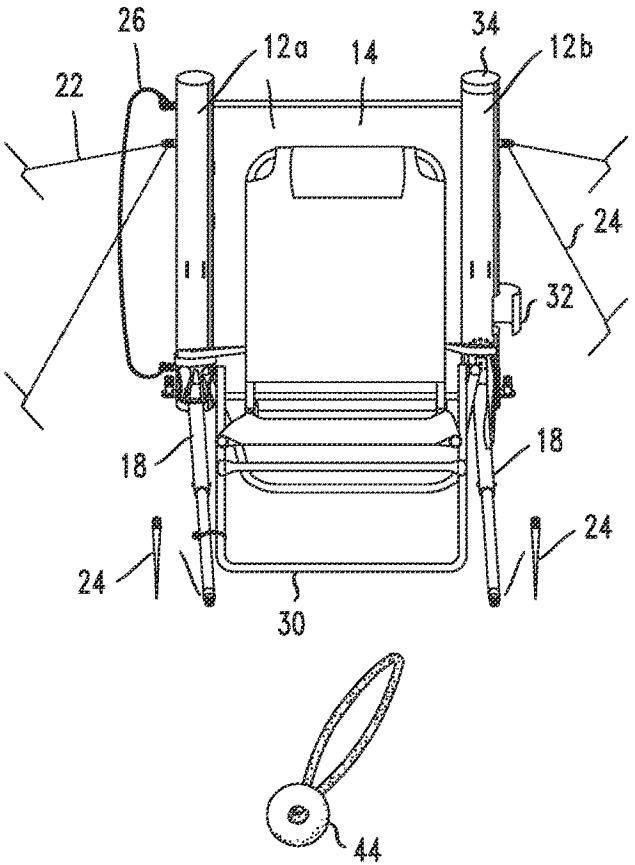
FIG. 12 is a front perspective view of a beach chair and one embodiment of the portable wind screen in its partially expanded configuration, wherein the chair frame is attached to a pivoting support via a stretchable ball and loop fastener.
Figure 14:
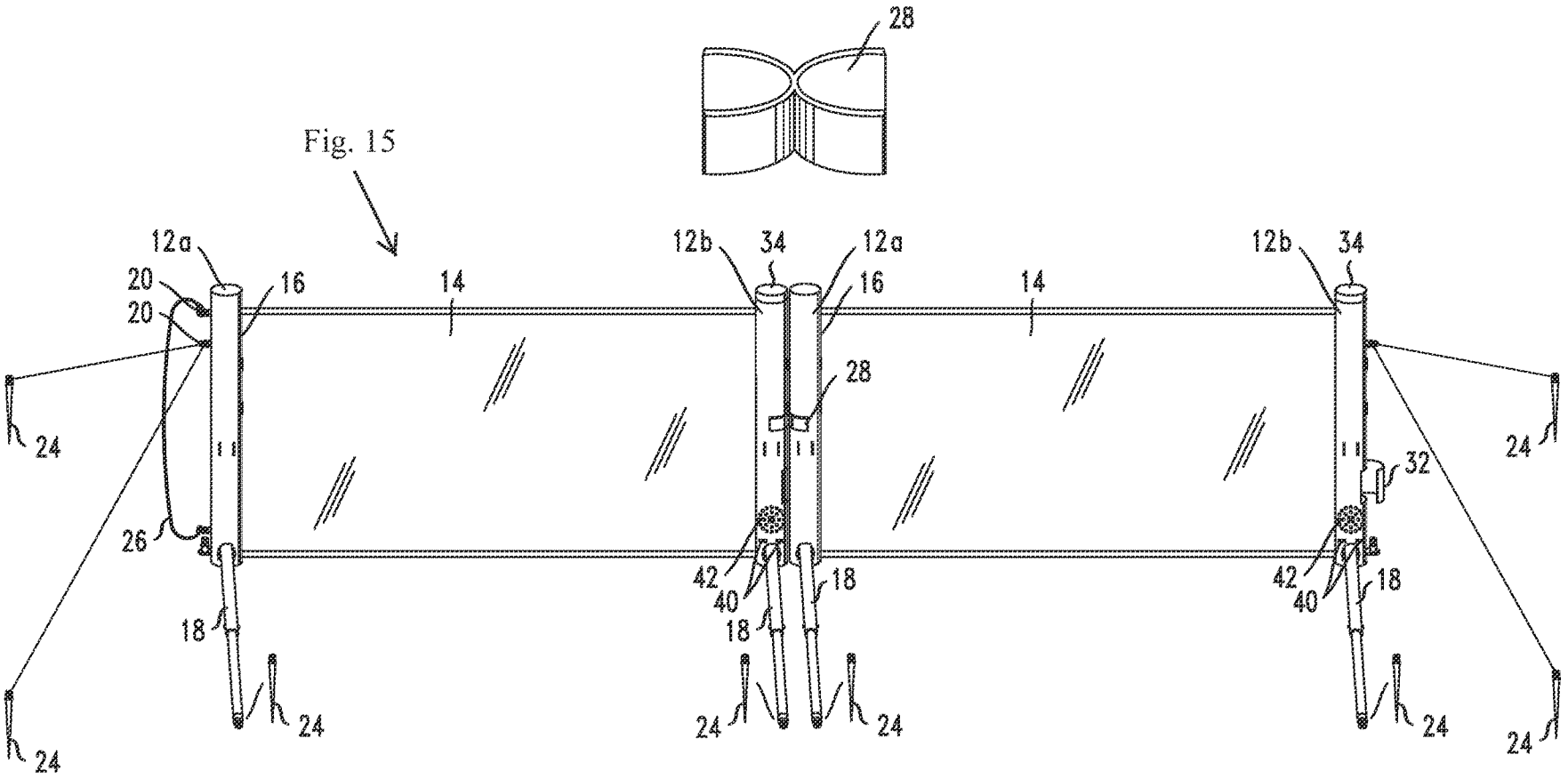
FIG. 14 is a perspective view of one embodiment of a clip, wherein the clip includes C-shaped sections on either end thereof, and wherein one C-shaped section is attachable to a support tube of one portable windscreen and the second C-shaped section is attachable to a support tube of a second portable windscreen, so that multiple portable windscreens may be linked together in linear or angular fashion.
Figure 18:
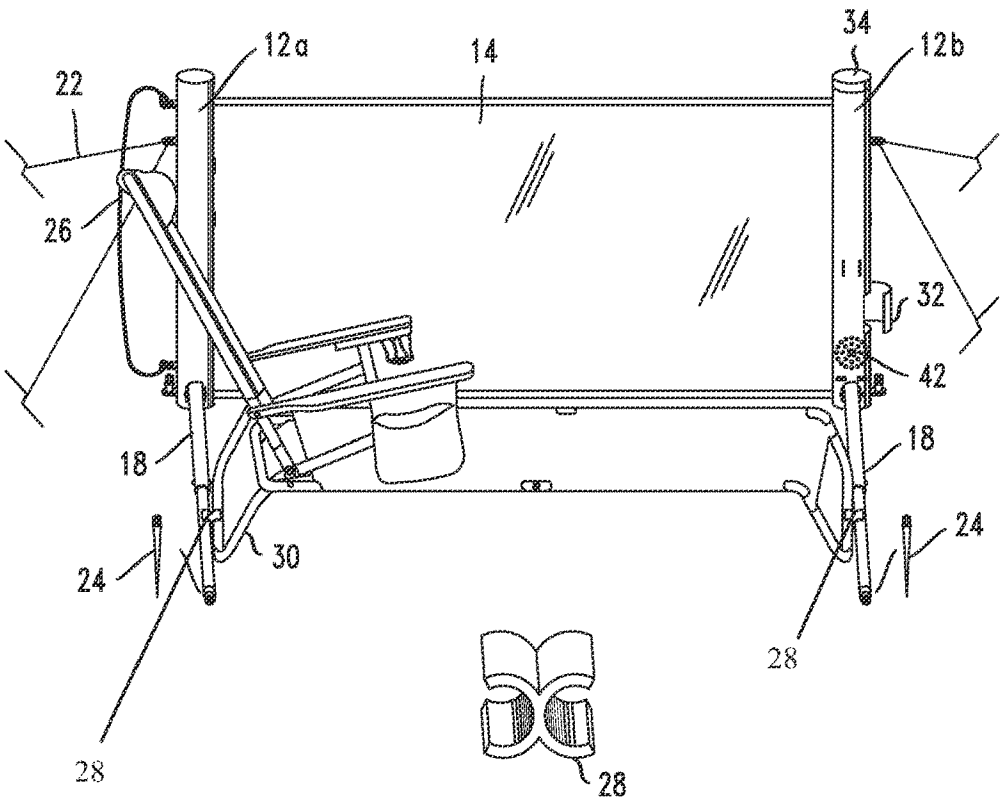
FIG. 18 is a front perspective view of a lounge chair and one embodiment of the portable wind screen in its expanded configuration, wherein the chair frame is attached to a pivoting support via a clip as shown in FIG. 7.
Figure 17:
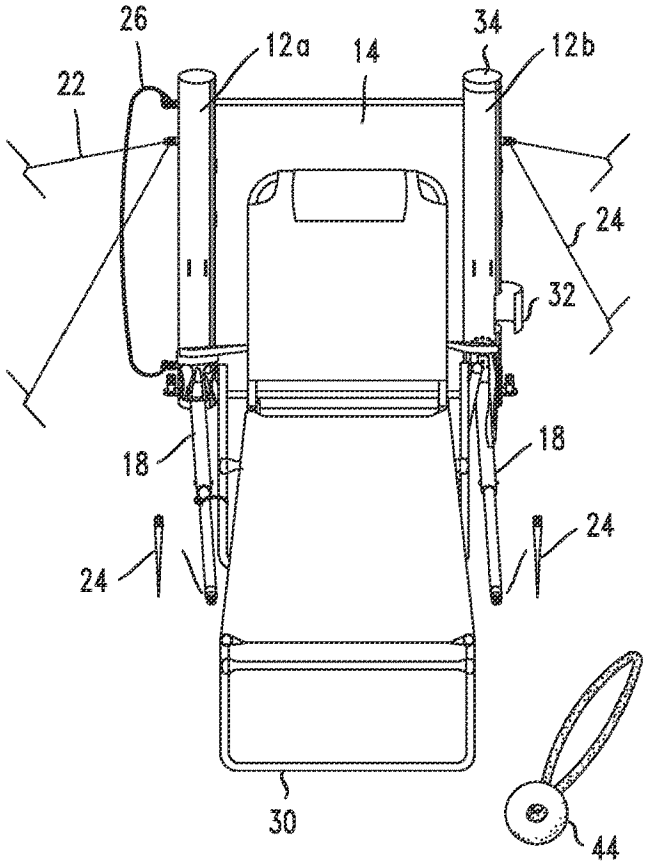
FIG. 17 is a front perspective view of a lounge chair and one embodiment of the portable wind screen in its partially expanded configuration, wherein the chair frame is attached to a pivoting support via a stretchable ball and loop fastener.

In one embodiment, the pivoting supports 18 may be configured in a telescoping fashion, as shown in FIGS. 11 and 13, so that the length of each pivoting support 18 may be adjusted. Optionally, clips 28 or other attachment means may be disposed on each end of the pivoting supports 18, so that the attachment means may be attached to the frame 30 of a beach chair, lawn chair, or the like, as shown in FIGS. 7, 8, 13 and 18. In this configuration, the pivoting supports 18 may be positioned in the horizontal position at a right angle with respect to the two support tubes 12*a* and 12*b*, and affixed to a chair frame 30 on either end (or both ends) thereof, so that the wind screen assembly 10 is temporarily affixed to the chair, as shown in FIGS. 13 and 18. The attachment means for temporarily securing the pivoting supports 18 to a chair frame 30 may include snap-fit clips 28, stretchable ball and loop fasteners 44 (as shown in FIG. 12) clamps, hook and loop fasteners, or any other suitable mechanisms for attachment to a chair. The telescoping nature of the pivoting supports 18 in this embodiment allows for the wind screen assembly 10 to be attached to chairs of different widths and sizes, and the pivoting supports 18 are preferably attached from beneath the chair in a preferred embodiment, although it is contemplated that the pivoting supports may positioned on the upper side of the chair and raised off of the ground, as well, if desired. It should also be understood that the pivoting supports may be attached to a chair in a raised position, so that the bottom of the support tubes and wind barrier are raised off of the ground, and are positioned at about the seat level, if desired.

Figure 3:
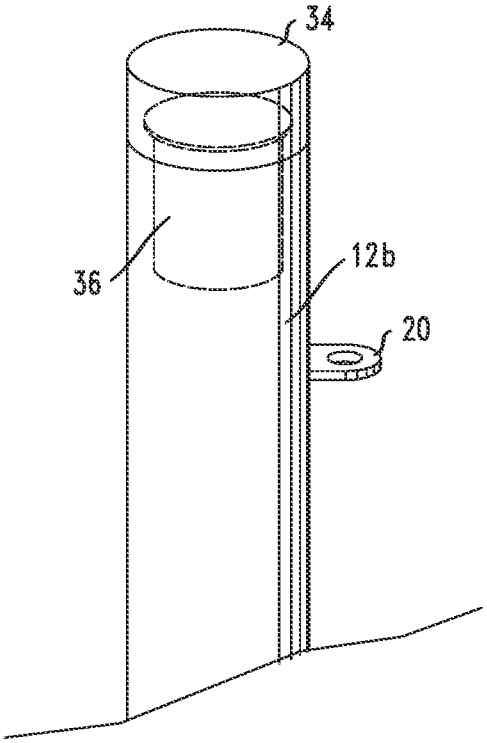
FIG. 3 is a perspective view of one embodiment of the top portion of a hollow support tube, including a threaded cap member, a removable cup member for holding stakes or other items, the upper portion of the support tube having an opening and an internal threaded section for receiving the threaded cap member, and an anchor point for attachment of a strap.
Figure 4:
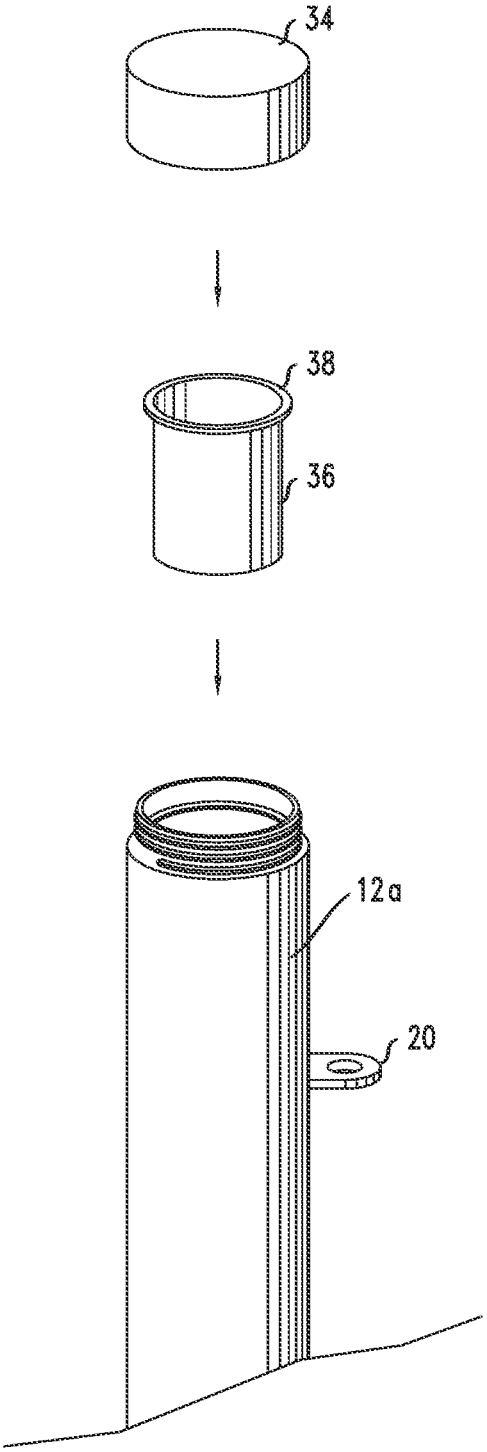
FIG. 4 is a perspective, exploded view of one embodiment of the top portion of a hollow support tube, including a threaded cap member, a removable cup member for holding stakes or other items, the upper portion of the support tube having an opening and an internal threaded section for receiving the threaded cap member, and an anchor point for attachment of a strap.

In one embodiment, as shown in FIGS. 3-6, the second support tube 12*b* may serve as a drink cooler and/or storage space for various items. For example, a series of canned or bottled drinks may be stacked vertically within the second tube 12*b*, which may also include a layer of insulation lining the inner wall of the second support tube 12*b* in order to keep the drinks cold. An access door 32 may be pivotally attached near the bottom of the second support tube 12*b* via a hinge or the like, so that a user may have access to retrieve the bottles or cans stacked therein while the wind screen assembly 10 is set up in its expanded configuration. Alternatively, the access door 32 may slide longitudinally along tracks on either side for opening or closing. Preferably, the access door 32 may include a latch or snap-fit mechanism that allows the access door 32 to be temporarily maintained in a closed position for storage and transport, but which allows a user to open the access door, as necessary. Further, in a preferred embodiment, the second support tube 12*b* may also include a threaded screw cap 34 that may be screwed onto the top portion of the second support tube 12*b*, as shown in FIGS. 3 and 4.

Optionally, as shown in FIGS. 3 and 4, a removable canister 36 may be used for holding ground stakes 24 and cords 22, or other small items, and includes an opening at a top portion thereof and a lip or flange 38 extending outwardly about the periphery of the top portion of the removable canister 36. The canister 36 is adapted to slide into the top of the second support tube 12*b*, and the lip 38 rests on the top perimeter of the second support tube 12*b*. The cap 34 then fits over the canister 36 and screws downwardly over the top of the second support tube 12*b*, thereby securing the canister 36 and any items held therein within the second support tube 12*b* for storage and transport purposes.

In another embodiment, a rechargeable battery may be affixed to either support tube, preferably inside the tube near a bottom portion thereof, and may include electrical ports or outlets, such as a USB port 40, for receiving a USB plug that may be attachable to a mobile phone, an electronic reader, or any other electronic device. In a preferred embodiment, the USB ports 40 are accessible through small portals disposed in the support tube 12*b*, so that a user can operationally connect the USB plug to the battery without removing the battery from the support tube 12*b*, particularly when the wind screen assembly 10 is set up in its expanded configuration. Additionally, a recharging port may also extend through a side of the support column, so that a user may simply plug a recharging cord into the battery through the side of the support tube at one end thereof, and plug the other end of the recharging cord into an electrical outlet in order to recharge the battery without removing it from the support tube 12*b*. It is contemplated that the rechargeable battery may be permanently affixed to the support tube 12*b*, or it may be removable.

Optionally, a wireless speaker 42 may be housed on or within one of the support tubes, and may be operationally connected to the above-referenced battery, or may have its own dedicated battery power source. The wireless speaker 42 may be wirelessly connected to a separate electronic mobile device, such as a smart phone, tablet, or the like, and the wireless connection may be via Bluetooth, WiFi, or any other suitable wireless communication means. Additionally, the wireless speaker 42 may be permanently attached to the support tube 12*b*, or alternatively, may be removable therefrom (similarly to the rechargeable battery described hereinabove).

In one embodiment, clips 28 (also referred to herein as 'connectors') or other attachment means may be used to connect multiple wind screen assemblies to one another in various configurations. In one embodiment, a series of snap-fit connectors 28 may include a main body member having C-shaped clips on opposed ends, so that a support tube 12*a* from one wind screen assembly may be attached to one side of the C-shaped clip 28, and the opposed side of the C-shaped clip 28 may attach to a support tube 12*b* from a second wind screen assembly. This arrangement allows a user to connect wind screen assemblies 10 either in a straight-line configuration (as shown in FIG. 15), or at an angle to one another, end to end. Although the connector 28 described herein includes C-shaped snap-fit connections between adjacent support tubes, it should be understood that any suitable connectors may be used to temporarily attach a support tube 12*a* from a first wind screen assembly to a support tube 12*b* from a second wind screen assembly, and multiple connectors 28 may be used in tandem, if desired.

Figure 10:
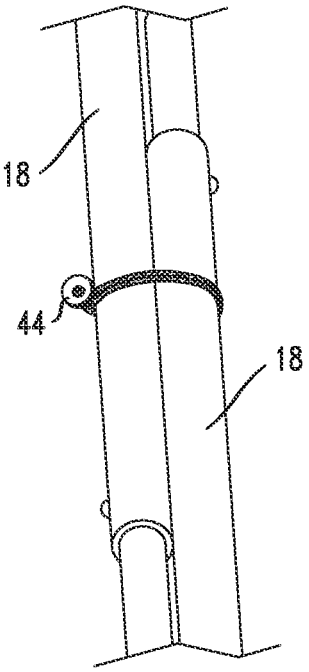
FIG. 10 is a perspective view of the stretchable ball and loop fastener shown in FIG. 9, wherein the ball and loop fastener in use connecting two pivoting support members that are attached to two separate windscreens disposed in parallel relation to one another.
Figure 16:
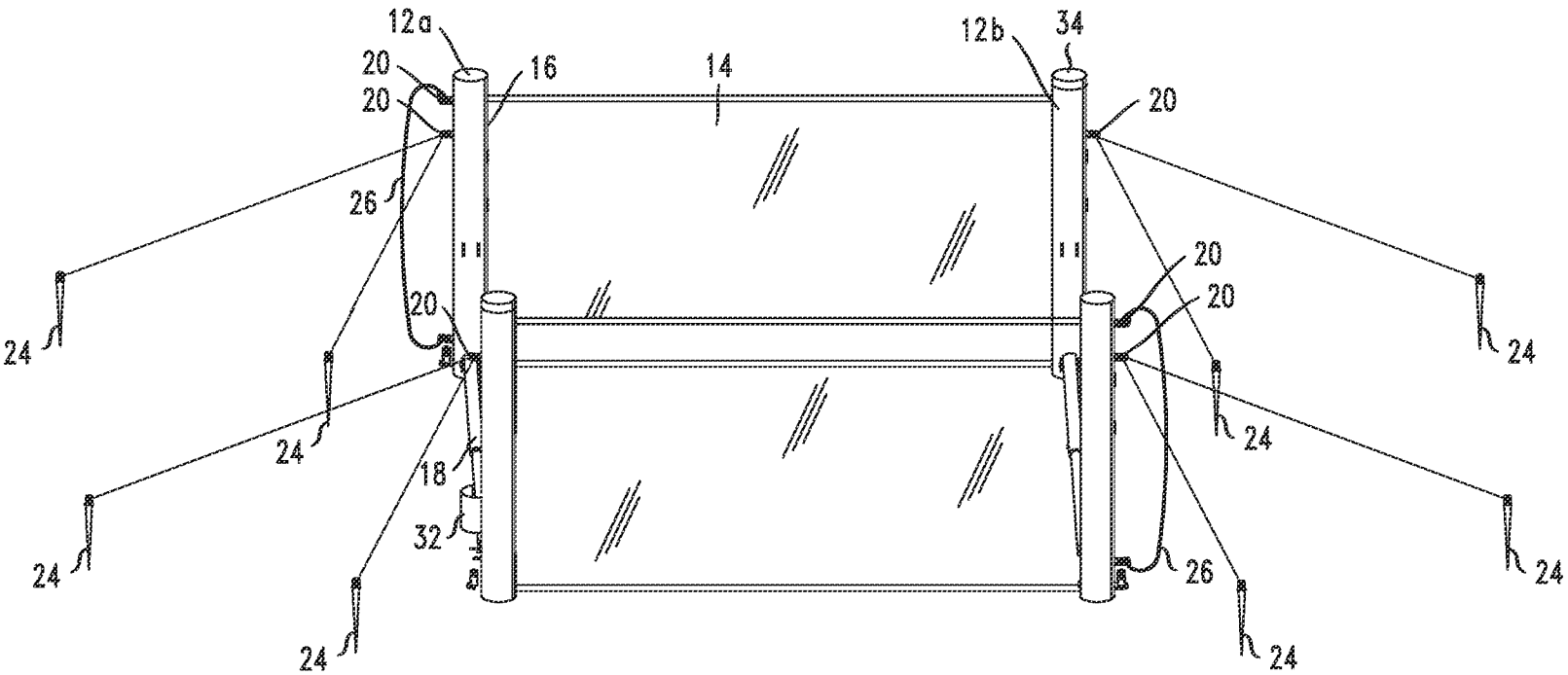
FIG. 16 is a perspective view of one embodiment of two portable wind screens disposed in parallel relation with one another, and wherein the pivoting supports from one portable wind screen are each attached to opposed pivoting supports of the other portable wind screen.

It is also contemplated that clips, snap-fit connectors, straps or other attachment means may be used to connect two wind screen assemblies in parallel relation, as shown in FIGS. 10 and 16. In this embodiment, the attachment means (shown as a stretchable ball and loop fastener 44) may be attached to the pivoting supports 18, so that when the wind screen assemblies 10 are placed in a parallel configuration, the pivoting supports 18 of one wind screen assembly 10 may be attached to opposed, corresponding pivoting supports 18 from the other wind screen assembly 10. It should be understood that other means may be employed to connect multiple wind screen assemblies in various configurations, without departing from the spirit or scope of the present invention.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A wind screen assembly comprising:

a first support tube defining a hollow interior cavity and defining an open longitudinal slot;

a spring-loaded winding mechanism disposed within said interior cavity of said first support tube;

a second support tube defining a hollow interior cavity therein;

wherein said second support tube includes a threaded upper portion for receiving a removable, threaded cap, so that said second support tube is adapted to temporarily hold and store items placed within said hollow cavity defined therein;

wherein said second support tube further includes a layer of insulation disposed about an inner periphery of said hollow cavity, so that said hollow cavity is adapted to receive a plurality of drinks in stacked relation;

a generally rectangular shaped windscreen having a first end and a second end, wherein said first end of said windscreen is operationally attached to said winding mechanism, said windscreen extending outwardly through said longitudinal slot of said first support tube, and said second end of said windscreen being attached to said second support tube; and each support tube including a pivoting support member attached thereto, so that said pivoting support members are adapted to pivot between a vertical position that is parallel with the corresponding support tube and a horizontal position that is generally at a right angle with said corresponding support tube.

2. The wind screen assembly set forth in claim 1, wherein said pivoting support members are formed into a telescoping arrangement so that each said pivoting support member may be adjusted lengthwise.

3. The wind screen assembly set forth in claim 1, wherein said second support tube further includes a hinged access door that may be temporarily secured in a closed position, and which may be opened in order to gain access to said hollow cavity disposed therein.

4. The wind screen assembly set forth in claim 1, further including a canister adapted to be received into an upper portion of said hollow cavity of said second support tube, so that said cap may be screwed onto said threaded portion of said second support tube while said canister is disposed within said hollow cavity.

5. The wind screen assembly set forth in claim 1, further including at least one connector for connecting one of said support tubes to a support tube from a second wind screen assembly.

6. The wind screen assembly set forth in claim 1, further including at least one connector for connecting one of said pivoting support members to a pivoting support member from a second wind screen assembly.

7. The wind screen assembly set forth in claim 1, further including a rechargeable battery disposed within one of said support tubes, and further including at least one electrical receptacle for receiving a plug used to recharge a mobile electronic device.

8. The wind screen assembly set forth in claim 7, wherein said electrical receptacle is a USB port.

9. The wind screen assembly set forth in claim 1, further including attachment means disposed on said pivoting support members for attaching said pivoting support members to a frame of a chair.

10. The wind screen assembly set forth in claim 1, further including a wireless speaker connected to one of said support tubes.

11. The wind screen assembly set forth in claim 10, wherein said wireless speaker is removably attached to said one of said support tubes.

12. The wind screen assembly set forth in claim 1, wherein each support tube includes at least one anchor point for attachment of a spike, a cord or a carrying strap.

13. The wind screen assembly set forth in claim 12, further including a carrying strap that is removably attachable to at least one of said anchor points.

14. A wind screen assembly comprising:

a first support tube defining a hollow interior cavity and defining an open longitudinal slot;

a spring-loaded winding mechanism disposed within said interior cavity of said first support tube;

a second support tube defining a hollow interior cavity therein;

wherein said second support tube includes a threaded upper portion for receiving a removable, threaded cap, wherein said second support tube is adapted to temporarily hold and store items placed within said hollow cavity defined therein;

a canister adapted to be received into an upper portion of said hollow cavity of said second support tube, so that said cap may be screwed onto said threaded portion of said second support tube while said canister is disposed within said hollow cavity;

a generally rectangular shaped windscreen having a first end and a second end, wherein said first end of said windscreen is operationally attached to said winding mechanism, said windscreen extending outwardly through said longitudinal slot of said first support tube, and said second end of said windscreen being attached to said second support tube; and each support tube including a pivoting support member attached thereto, so that said pivoting support members are adapted to pivot between a vertical position that is parallel with the corresponding support tube and a horizontal position that is generally at a right angle with said corresponding support tube.

15. The wind screen assembly set forth in claim 14, wherein said pivoting support members are formed into a telescoping arrangement so that each said pivoting support member may be adjusted lengthwise.

16. The wind screen assembly set forth in claim 14, further including a rechargeable battery disposed within one of said support tubes, and further including at least one electrical receptacle for receiving a plug used to recharge a mobile electronic device.

17. The wind screen assembly set forth in claim 16, wherein said electrical receptacle is a USB port.

18. The wind screen assembly set forth in claim 14, further including a wireless speaker connected to one of said support tubes.

* * * * *